United States Patent [19]

Yano et al.

[11] 4,395,079

[45] Jul. 26, 1983

[54] PLASTIC MOLDED MESH SCREEN COVERING FOR AUDIO CABINETS

[75] Inventors: Masayoshi Yano; Fuminori Hirose, both of Hirakata, Japan

[73] Assignee: Matsushita Electric Industrial Co., Ltd., Osaka, Japan

[21] Appl. No.: 226,089

[22] Filed: Jan. 19, 1981

[30] Foreign Application Priority Data

Jan. 19, 1980 [JP] Japan ..... 55/4793
Jan. 19, 1980 [JP] Japan ..... 55/4886[U]

[51] Int. Cl.[3] ..... A47B 81/06

[52] U.S. Cl. ..... 312/7.1; 264/299; 160/371

[58] Field of Search ..... 312/7.1, 7.2; 160/371, 160/380; 264/299, 331.11; 52/309.15, 660

[56] References Cited

U.S. PATENT DOCUMENTS

| | | | |
|---|---|---|---|
| D. 144,545 | 4/1946 | Flanagan | 312/7.1 |
| D. 144,863 | 5/1946 | Martial et al. | 312/7.1 |
| D. 154,817 | 8/1949 | Steinke | 312/7.2 |
| 1,323,331 | 12/1919 | Steiner | 312/7.1 |
| 2,557,244 | 6/1951 | Belov | 312/7.1 |
| 2,577,528 | 12/1951 | Kennedy | 312/7.1 |
| 3,214,314 | 10/1965 | Rowbottam | 160/371 |
| 3,363,957 | 1/1968 | Basch | 312/7.1 |
| 3,914,368 | 10/1975 | Harkness | 264/299 |
| 4,018,864 | 4/1977 | Minssen et al. | 264/299 |
| 4,079,500 | 3/1978 | Tolliver | 264/299 |

*Primary Examiner*—Victor N. Sakran
*Attorney, Agent, or Firm*—Birch, Stewart, Kolasch & Birch

[57] ABSTRACT

A cabinet having a loudspeaker window has a mesh screen structure covering the window. This mesh screen structure is made by the use of a plastics molding technique and comprises a plurality of latitudinal threads and a plurality of longitudinal threads molded together to give a shape or appearance similar in all aspects to a woven metal mesh.

6 Claims, 15 Drawing Figures

PLASTIC MOLDED MESH SCREEN COVERING FOR AUDIO CABINETS

BACKGROUND OF THE INVENTION

The present invention generally relates to a cabinet of the type having a sound emitting window for electric audio equipment such as a radio receiver or magnetic tape recording and/or reproducing apparatus and, more particularly, to a mesh screen structure covering the sound emitting window of the cabinet which is formed by the use of a plastics molding technique.

According to the prior art, a screen covering the sound emitting window of a cabinet for audio equipment for example, for protecting a loudspeaker is generally manufactured from a single sheet or plate of synthetic resin by the use of a blanking technique to form a plurality of perforations of a predetermined pattern or to produce a generally grid-shaped screen. The appearance of the screen covering the sound emitting window of the cabinet which is generally manufactured according to the prior art is very simple, and the existing plastics molding techniques have not yet been developed to such an extent as to enable the production of a plastic mesh screen structure similar in shape and configuration to a woven metal mesh. Accordingly, when it comes to a mesh screen, a woven metal mesh has long been used for covering the sound emitting window of the cabinet or the loudspeaker box thereby providing a sophisticated and good-looking appearance. However, a method for manufacturing a plastic mesh similar in all aspects to the woven metal mesh by the use of the existing plastic molding techniques has not been developed because of a number of difficulties involved in the design and manufacture of a mold assembly having a molding cavity and cores for the production of the plastic mesh screen.

SUMMARY OF THE INVENTION

Accordingly, the present invention has for its essential object the providing of a cabinet integrally formed with a plastic screen structure covering a sound emitting window which is manufactured by the use of a plastics molding technique.

Another object of the present invention is to provide a cabinet of the type referred to above, wherein the plastic screen structure is similar in all aspects to a woven metal mesh and which can be manufactured at a reduced cost as compared with a similar cabinet having the woven metal mesh for the screen.

BRIEF DESCRIPTION OF THE DRAWINGS

These and other objects and features of the present invention will become apparent from the following description taken in conjunction with preferred embodiments of the present invention with reference to the accompanying drawings, in which:

FIG. 5(*b*) is a view similar to FIG. 5(*a*), showing a plastic screen structure according to the present invention;

FIG. 6(*b*) is a front elevational view of FIG. 6(*a*);

FIG. 7(*b*) is a cross-sectional view taken along the line Q—Q in FIG. 7(*a*);

DETAILED DESCRIPTION OF EMBODIMENTS

Figure 1:
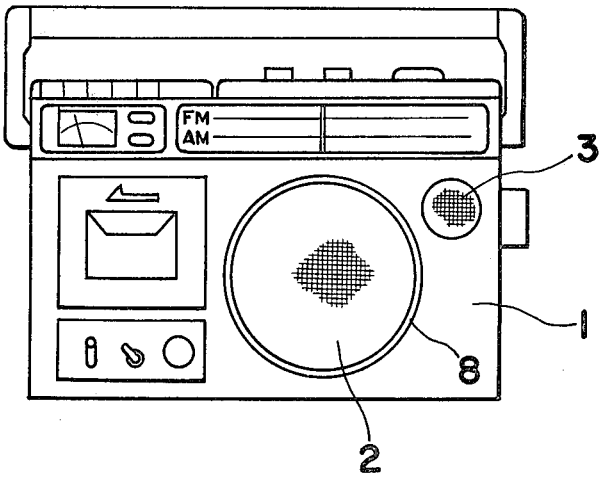
FIG. 1 is a front elevational view of a cabinet of an audio equipment embodying the present invention.

Before the description of the present invention proceeds, it is to be noted that like parts are designated by like reference numerals throughout the accompanying drawings.

Figure 2:
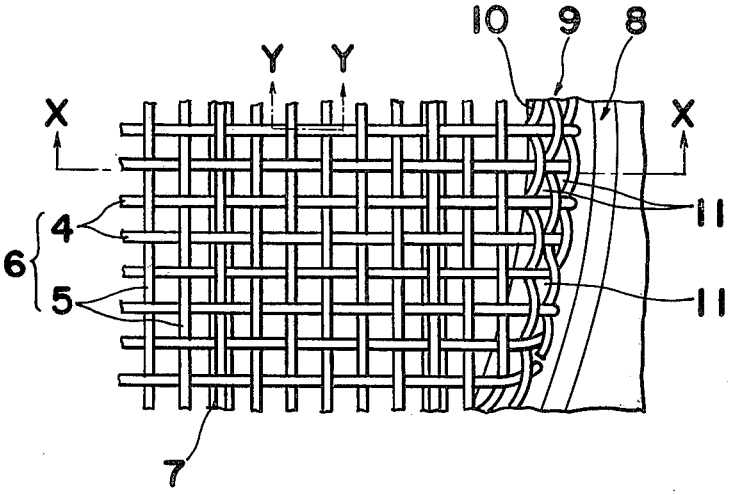
FIG. 2 is a front elevational view, on an enlarged scale, of a portion of a plastic screen structure used to cover any one of the sound emitting windows embodied in the cabinet shown in FIG. 1.
Figure 3:
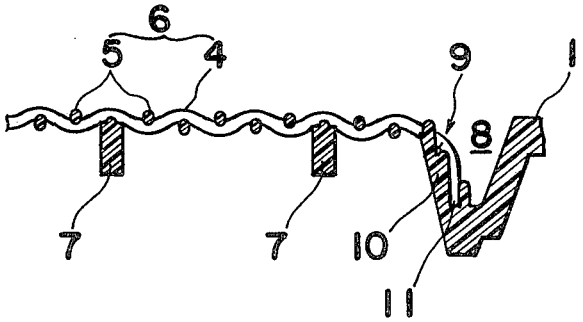
FIG. 3 is a cross-sectional view taken along the line X—X in FIG. 2.

Referring to FIG. 1, there is seen a cabinet 1 for a combined radio receiver and magnetic tape player. This cabinet 1 has both large diameter and reduced diameter sound emitting windows 2 and 3 defined in a front panel portion made by a plastics molding technique, said sound emitting windows 2 and 3 being provided respectively with woofer and tweeter. As best shown in FIG. 2, the sound emitting window 2 is covered with a plastic mesh screen structure 6 formed of a plurality of equally spaced latitudinal threads 4 and a plurality of equally spaced longitudinal threads 5 perpendicular to the latitudinal threads 4, all of said threads 4 and 5 being so arranged and so patterned as to represent a shape or appearance similar to a flat-woven metal mesh. As shown in FIG. 3, reference numeral 7 represents reinforcement ribs integrally molded with the cabinet 1 so as to extend across the sound emitting window 2 in a direction parallel to either the latitudinal or longitudinal threads 4 and 5, for example, herein represented as parallel to the longitudinal threads 5 and so illustrated. These reinforcement ribs 7 are so formed integrally and so arranged that some of the longitudinal threads 5 aligned with such reinforcement ribs 7 extend atop the corresponding reinforcement ribs 7, while the latitudinal threads 4 are carried back and forth across some of the longitudinal threads 5. In this construction, as best shown in FIG. 3, the latitudinal and longitudinal threads 4 and 5 are integrally united together at each point of the intersection of threads 4 and 5 so that the resultant plastic mesh screen structure can represent a shape or appearance as if the latitudinal threads 4 and the longitudinal threads 5 were carried back and forth across each other in a manner similar to a woven metal mesh.

The peripheral edge portion 9 of the plastic mesh screen structure 6, which is constituted by the opposite ends of each of the threads 4 and 5, is so bent to protrude in a direction generally perpendicular to a major portion of the screen structure 6 such that, by engaging and bonding the bent peripheral edge portion 9 of the screen structure 6 into a circular groove 8 defined in the cabinet 1, so as to encircle the sound emitting window 2, the screen structure 6, according to the present invention, can be fitted to the front panel portion of the cabinet 1 in alignment with the sound emitting window 2. Specifically, in order for the bent peripheral edge portion 9 of the screen structure to exhibit a substantially braided shape, an annular base wall 10, integral with the cabinet 1 and defining the circular groove 8, is formed with extensions of the threads 4 and 5 extending outwards therefrom, with a portion defined between the threads 4 and 5, which correspond to each aperture, being formed into a recess 11 opening upwards as shown in FIG. 3.

Figure 4:
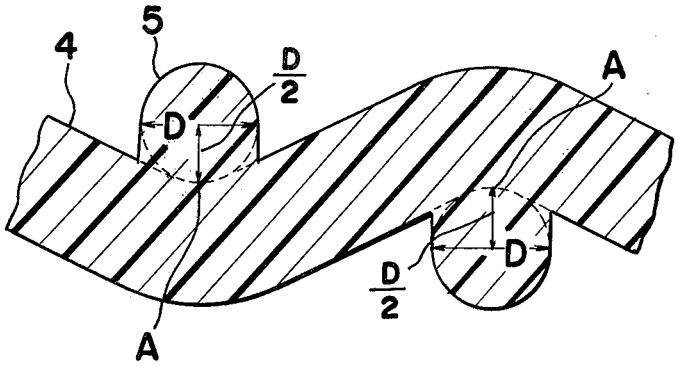
FIG. 4 is a cross-sectional view, on a further enlarged scale, taken along the line Y—Y in FIG. 2.

Each intersecting area of the latitudinal and longitudinal threads 4 and 5 is such as shown in FIG. 4 which shows a cross-section of the screen structure taken along the line X—X in FIG. 2. As best shown in FIG. 4, each of the latitudinal threads 4 is integral with the longitudinal threads 5 at the intersecting area. In order for the plastic mesh screen structure 6 to be manufactured by the use of the plastics molding technique, care should be taken that the width of the half portion of the thread disposed below the diameter D, as measured between the apparent point A of the intersection of the thread 4 and 5 to each of the opposite points of each thread 4 or 5 in a direction of the diameter D (that is, the opposite lateral sides on both sides taken horizontally with respect to the center of such thread 4 or 5) should be substantially equal to the diameter D. As a result, even when, for example, a mold parting line is defined so as to pass through the apparent points A of intersection of the threads 4 and 5, removal of a mold relative to a counter mold is possible, thereby enabling the manufacture of a plastic mesh screen structure similar in shape or appearance to a woven metal mesh.

The fact that half the diameter D is substantially equal to the diameter D of each thread 4 or 5 is required to enable one mold to be separable from the counter mold during the plastics molding operation to make the plastic mesh screen structure 6. This will be described in detail with particular reference to FIGS. 5(*a*) and 5(*b*).

Figure 5A:
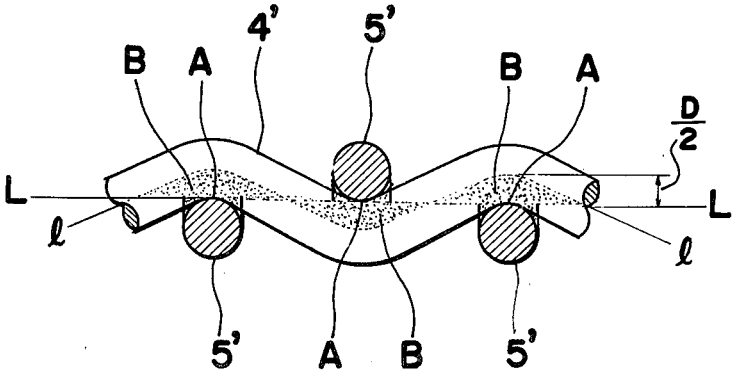
FIG. 5(*a*) is a cross sectional view of a woven metal mesh shown for the purpose of explanation of the present invention.
Figure 5B:
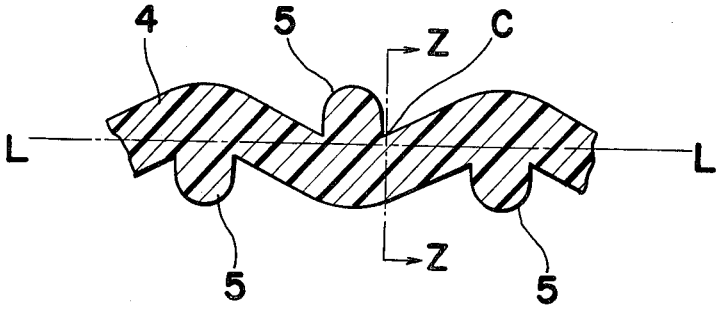
Figure 6:
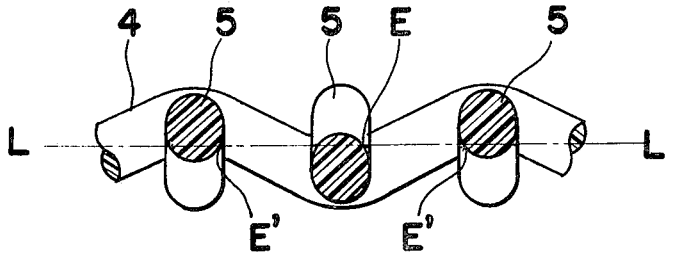
FIG. 6(*a*) is a cross-sectional view taken along the line Z—Z in FIG. 5(*b*)
Figure 6:
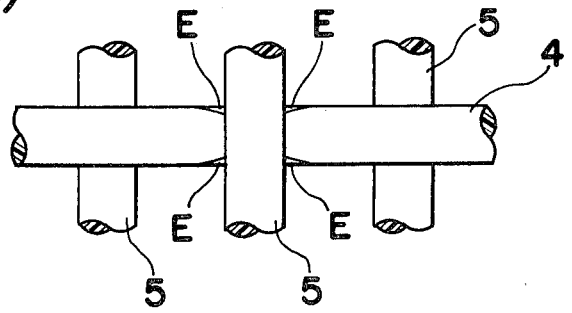

Shown in FIG. 5(*a*) is a cross-sectional shape of a portion of a woven metal mesh. This woven metal mesh is, as is well known to those skilled in the art, composed of a plurality of latitudinal wires 4' of circular cross-section and a plurality of longitudinal wires 5' of circular cross-section carried back and force across the latitudinal wires 4'. If a mesh similar to that shown in FIG. 5(*a*) is to be formed by the use of a plastics molding technique, and assuming that the mold parting line L lies in a plane containing and passing through the points A of intersection of wires 4' and 5', areas B depicted with dots would become respective portions of the resultant mesh that can not be separated from the mold. These areas B result from the fact that the maximum dimension of each intersecting area of the wires 4' and 5' as measured between the parting line L and the longitudinal axis of each of the wires 4' and 5' is half the diameter D, i.e., D/2, according to the wavy configuration of these wires 4' and 5'. Therefore, if the diameter of each of the areas B is made to be substantially equal to the diameter D of each of the wires 4' and 5', the areas B, which cannot be separated from the mold, could be eliminated. In view of this, in the present invention, as best shown in FIG. 5(*b*) the areas of intersection of the threads 4 and 5, which possibly correspond to the areas B shown in FIG. 5(*a*), are united together with the threads 4 and 5. In other words, the diameter of the portion (the area B) disposed between the line shown by l in FIG. 5(*a*) and representing the location of the diameter of each wire 4', and the mold parting line L is required to be substantially equal to the diameter D.

Where the parting line L is defined as located on the plane containing and passing through the apparent points A of intersection of the threads 4 and 5 such as shown in FIG. 5(*b*), the cross-sectional shape of the screen structure taken along the line Z—Z passing through a valley C defined between the threads 4 and 5 at the front face is such as shown in FIG. 6(*a*). Each valley C is the lower area where an upper face of each thread 4 has been positioned in the closest vicinity of the parting line L and gives a difference in shape between the upper and lower sides with respect to the parting line L, exposing a portion of the upper mold parting face E at the upper side, as viewed in FIG. 6(*a*), which will serve the front face of the screen structure 6. This face E, when viewed from the front as shown in FIG. 6(*b*), is undesirable. The formation of the parting face E occurs equally in the lower side opposite to the upper side in the form of a lower mold parting face E'.

Figure 7:
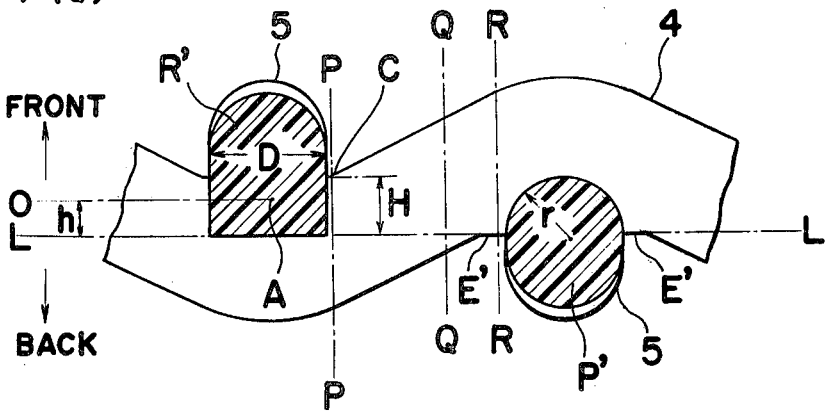
FIG. 7(*a*) is a view similar to FIG. 4, showing the plastic mesh screen structure according to another embodiment of the present invention.
Figure 7:
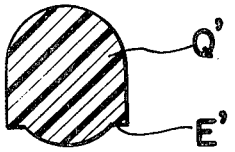

The embodiment wherein the exposure of the parting faces E at the front face of the screen structure 6 facing outwards relative to the cabinet 1, such as shown in FIGS. 6(*a*) and 6(*b*), is shown in FIGS. 7(*a*) and 7(*b*). FIG. 7(*a*) shows a cross-sectional view, on an enlarged scale, corresponding to that taken along the line X—X in FIG. 2. In this embodiment, the mold parting line L has been defined as located so as to lie in a plane displaced a distance rearwardly of the resultant screen structure 6 from the plane containing and passing through the apparent points A of intersection of the threads 4 and 5, the distance of displacement being indicated by h in FIG. 7(*a*). Preferably, this distance h of displacement must be of such a value that the dimension shown by H and drawn vertically, as viewed in FIG. 7(*a*), from each valley C to the parting line L is equal to or larger than half the diameter D, that is, the radius $\gamma$, of each of the threads 4 and 5. That is to say, when the distance h of displacement is selected to be such a value as to satisfy the requirement of $H \geqq \gamma$, the presence of the parting faces E can be avoided. In other words, as shown by P' in FIG. 7(*a*), which P' represents a cross-sectional shape taken along the line P—P in FIG. 7(*a*) passing through the valley C, a portion of each thread 4 or 5 at the intersection with the other threads 5 or 4, which is positioned above the parting line L, is shaped to assume a semi-circular cross-section with no parting face E formed thereon. Accordingly, it is clear that it is a minimum requirement to make the dimension H equal to the radius $\gamma$ in order to eliminate the formation of the parting faces E. A cross-sectional view taken along the line Q—Q in FIG. 7(*a*) is shown by Q' in FIG. 7(*b*). As shown in FIG. 7(*b*), each thread 4 is shown as having parting faces E' at a lower portion thereof. On the other hand, a portion R' of each thread 4 when viewed in a cross-section taken along the line R—R in FIG. 7(*a*) has the parting face E' extending over the entire width thereof as shown in FIG. 7(*a*).

In the embodiment shown in FIGS. 7(*a*) and 7(*b*), since the formation of the parting faces E on the front face of the screen structure 6 has been eliminated, the resultant screen structure 6 can give a convincing appearance similar to a woven metal mesh.

The plastic mesh screen structure 6 may be convexed outwardly relative to the sound emitting window 2 an example of which will now be described with particular reference to FIG. 8.

Figure 8:
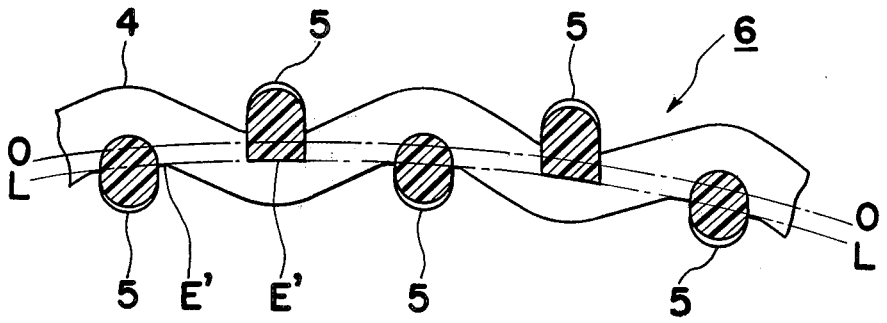
FIG. 8 is a cross-sectional view of a portion of the plastic mesh screen structure of curved type according to a further embodiment of the present invention.

In the embodiment shown in FIG. 8, the center plane O of the screen structure 6 which lies in between the thickness thereof and which contains and passes through the apparent points A of intersection of these threads 4 and 5 is, when viewed in cross-section as shown in FIG. 8, curved. The manufacture of the screen structure 6 so convexed as hereinbefore described and shown in FIG. 8 can be accomplished by using the mold wherein the parting line L is correspondingly curved according to the curvature of the screen structure and, at the same time, is displaced the distance h from the plane containing and passing through the apparent points A of intersection of the threads 4 and 5. The screen structure 6 so manufactured has threads 4 and 5, the opposite sides of each of which may not lie at right angles to the parting line L at some local areas. This is because the threads 4 and 5 intersecting with each other have their sides so shaped as to facilitate separation of the mold relative to the screen structure 6.

Figure 9:
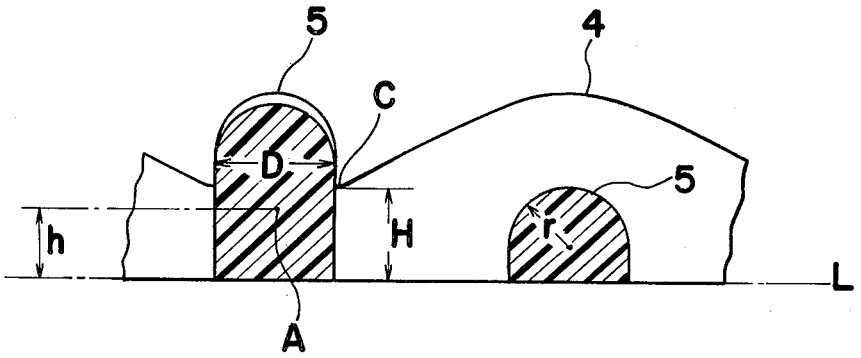
FIG. 9 is a view similar to FIG. 8, showing the plastic mesh screen structure of a type having a planar backside according to a still further embodiment of the present invention.

The plastic mesh screen structure 6 according to the present invention may have its back face made flat as shown in FIG. 9. This can be manufactured by the use of a mold having a flat-bottomed molding cavity sufficient to define the flat back face of the screen structure 6. That is to say, in the embodiment shown in FIG. 9, the diameter of the portion between the parting line L and the location of the diameter of each thread 4 or 5 is made substantially equal to the diameter D of such thread 4 or 5. In addition, in the embodiment shown in FIG. 9, by selecting the dimension H and distance h to be larger than that discussed hereinbefore, the physical strength of the screen structure 6 can be improved. In this case, where the back face of the screen structure 6 facing towards the loudspeaker aligned with the sound emitting window 2, is made flat, the manufacture thereof can readily be performed since the mold necessary to define the back face of the screen structure 6 is simple in construction having a flat-bottomed molding cavity.

Figure 10A:
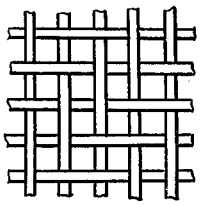
FIGS. 10(*a*) to 10(*c*) illustrate respective plastic mesh screen structures according to other embodiments of the present invention.
Figure 10B:
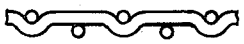
Figure 10C:
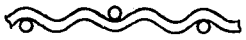

In the foregoing embodiments of the present invention, the latitudinal and longitudinal threads 4 and 5 have been described as arranged and patterned to provided a shape similar to a flat woven metal mesh. However, they may be so arranged and so patterned as to provide a shape or appearance similar to any of metal meshes woven in a twilled fashion as shown in FIG. 10(*a*), in a flat top fashion as shown in FIG. 10(*b*) or in a crimped fashion as shown in FIG. 10(*c*).

From the foregoing description of the present invention, it has now become clear that the plastic mesh screen structure 6 covering the sound emitting window 2 can be formed integrally with the cabinet and that the screen structure 6 represents a shape or appearance similar in all aspects to a woven metal mesh. Accordingly, the cabinet which is attractive to look at can be manufactured easily and at a reduced cost only by the use of a plastic molding technique as compared with the manufacture of a similar cabinet having a woven metal mesh for covering a sound emitting window.

Although the present invention has fully been described in connection with the preferred embodiments thereof with reference to the accompanying drawings, it is to be noted that various changes and modifications are apparent to those skilled in the art. By way of example, the screen structure according to the present invention can equally be used for covering the sound emitting window for the tweeter.

Accordingly, such changes and modifications are to be understood as included within the true spirit of the present invention unless they depart from the scope of the appended claims.

We claim:

1. A molded plastic mesh screen covering for at least one sound emitting opening defined in an audio cabinet, said mesh screen structure comprising a plurality of equally spaced latitudinal threads extending generally perpendicular to a plurality of equally spaced longitudinal threads, said latitudinal and longitudinal threads being interwoven so as to intersect to be integrally interconnected together at each area of intersection to provide a unitary structure having a diameter measured from a mold parting line, said line defined as passing through said areas of intersection, to a diametrically opposite point on each of said respective threads in a direction facing outwardly from said cabinet, said diameter being substantially equal to the diameter of said threads.

2. A cabinet including the plastic mesh screen as claimed in claim 1, wherein said cabinet is formed integrally with a plurality of reinforcement ribs spaced from each other at predetermined intervals running parallel and in contact with either of said latitudinal or longitudinal threads such that either of said latitudinal or longitudinal threads extend atop said corresponding reinforcement rib, said reinforcement ribs extending along said respective threads at a position facing inwardly with respect to said cabinet.

3. A cabinet as claimed in claim 2, wherein said parting line is displaced at a predetermined distance in a direction towards said cabinet from the center plane of said screen structure which contains and passes through the apparent points of intersection of said threads, the dimension between the lowest portion of said threads at the intersecting area of one side facing outwardly of the cabinet and the parting line being selected to be equal to or larger than the radius of each of said threads.

4. A cabinet having at least one opening defined therein, which comprises a housing, a plastic mesh screen structure covering said opening, said screen structure comprising a plurality of equally spaced latitudinal threads and a plurality of equally spaced longitudinal threads extending generally perpendicular one to the other, said latitudinal and longitudinal threads being molded together at areas of intersection to be integrally interwoven, said screen structure defining a mold parting line at a location displaced a predetermined distance in a direction towards said cabinet from an imaginary plane which contains and passes through said areas of intersection of said threads, that is, from the center plane of the screen structure which lies in between the thickness of said screen structure, the diameter of which, defined as measured from said mold parting line to diametrically opposite points on each of said respective threads in both directions facing outwardly and inwardly of said cabinet, being substantially equal to the diameter of said threads.

5. The cabinet of claim 4, wherein said cabinet is formed integrally with a plurality of reinforcement ribs spaced from each other at predetermined intervals running parallel and in contact with either of said latitudinal or longitudinal threads such that either of said latitudinal and longitudinal threads extend atop said corresponding reinforcement rib, said reinforcement ribs extending along said respective threads at a position facing inwardly of said cabinet.

6. A cabinet as claimed in claim 4, wherein the dimension between the mold parting line and the lowest portion at the intersecting area on one side facing outwardly of the cabinet is selected to be equal to or larger than the radius of the threads.

* * * * *